US005230160A

United States Patent [19]

Gross et al.

[11] Patent Number: 5,230,160

[45] Date of Patent: Jul. 27, 1993

[54] REDUCTION OF AFLATOXIN CONTENT IN PEANUTS

[75] Inventors: David R. Gross; Marvin Kragt, both of Orrville; Robert J. Valenzky, Jr., Akron, all of Ohio

[73] Assignee: The J. M. Smucker Company, Orrville, Ohio

[21] Appl. No.: 933,693

[22] Filed: Aug. 24, 1992

[51] Int. Cl.[5] ..... F26B 3/34

[52] U.S. Cl. ..... 34/1 T; 34/1 P; 34/15; 34/92

[58] Field of Search ..... 34/1 P, 1 T, 1 U, 1 V, 34/92, 15, 4; 219/10.55 R, 10.55 M

[56] References Cited

U.S. PATENT DOCUMENTS

| | | | |
|---|---|---|---|
| 3,276,138 | 10/1966 | Fritz | 34/1 T |
| 4,015,341 | 4/1977 | McKinney et al. | 34/15 |
| 4,204,336 | 5/1980 | Le Viet | 34/1 P |
| 4,622,448 | 11/1986 | Awata et al. | 34/1 T |
| 5,020,237 | 6/1991 | Gross et al. | 34/1 P |

*Primary Examiner*—Henry A. Bennet
*Assistant Examiner*—Denise L. Gromada
*Attorney, Agent, or Firm*—Body, Vickers & Daniels

[57] ABSTRACT

Peanuts with a moisture content of from 6% to 15% are subjected to vacuum drying and/or roasting in a chamber using microwave energy to ensure penetration of the kernel. Aflatoxin compounds are destroyed and/or driven off with the vapors exiting the vacuum chamber.

41 Claims, No Drawings

REDUCTION OF AFLATOXIN CONTENT IN PEANUTS

BACKGROUND OF THE INVENTION

This invention relates to the art of removal of aflatoxin from cereals, oil seeds and feedstuffs which are contaminated therewith and, more particularly, to an improved method for the removal of aflatoxin from cereals, oil seeds and feedstuffs.

It is of course well known that aflatoxin is a specific mycotoxin produced by the action of a fungi belonging to the genus, aspergillus, on grain, seeds, kernels or nuts. Aflatoxins are a group of related, complex, hetercyclic chemical compounds. These compounds are very slightly soluble in water and in the crystalline form melt (and decompose) at temperatures in the 240° C. to 280° C. range.

Aflatoxin contamination is particularly problematic in the peanut industry and, in addition, can affect grains such as corn and rice, other oil seeds such as cotton seed, and meals of such grains and seeds which are often used as feed for domestic animals. The growth of fungi which produce aflatoxin is favored under the same conditions which are good for growing nuts and grains. High levels of aflatoxin in foods and feeds presents a threat to humans and animals in that aflatoxins have been shown to cause cancer in laboratory animals. Accordingly, the U.S. Food & Drug Administration has set limits on the amount of aflatoxin that can be in food products, namely less than 20 ppb. The production of aflatoxin results from unfavorable conditions of harvesting and storage, namely high humidity and moisture content.

Peanuts often contain visibly damaged kernels which often contain high contents of aflatoxins. The darker color of these kernels, especially after roasting, enables them to be sorted out thus reducing aflatoxin content. However, it is well known that the mold mycelia can enter perfectly sound peanuts producing aflatoxins in kernels that show no visible imperfections. Thus, even the most rigorous color sorting will often fail to reduce the aflatoxin of highly contaminated lots of peanuts to acceptable levels.

A wide variety of processes have been explored heretofore with respect to reducing the level of aflatoxin contamination in peanuts and peanut meal, including autoclaving, heat treating or roasting, chemical inactivation and microwave heating at atmospheric pressure. All of these processes have met with some success, insofar as reduction of aflatoxin is concerned, but there are limitations and disadvantages which accompany these processes and which either result in less than desired reductions in the level of aflatoxin contamination, result in a contaminated product which is not commercially acceptable and/or involve process parameters which are not acceptable in connection with the production of product on a commercial basis. For example, normal peanut roasting, either oil or dry, to produce a commercially acceptable peanut, such acceptance basically being by color, only reduces aflatoxin B1 by about 5% to 40%. In many cases, this reduction is due to the fact that roasting has excessively darkened damaged kernels to the point where they can be color sorted. In any event, if the contamination level is 200 ppb, for example, roasting leaves the contamination level unacceptably high. While aflatoxin B1 can be reduced by about 80% by roasting at high temperatures and/or for long periods of time, the latter results in the peanuts being over roasted and unacceptable either because of the excess browning color thereof and/or the loss of the nutritional value thereof.

Other efforts to reduce aflatoxin contamination have included chemical inactivation through the use of ammonia, methylamine, sodium hydroxide, ozone and acetone, for example. Chemical treatment or extraction, however, is undesirable for a number of reasons including process time, the provision and cost of special equipment, and the potential for residual odor in the decontaminated product. Peanuts and peanut meal have also been microwave roasted at atmospheric pressure as an alternative to conventional oven roasting. Those familiar with the application of microwave energy will understand that it is a penetrative radiation. When peanuts or other objects are subjected to microwaves, the heating effect is from the center out. This is contrasted to conventional oven methods where hot gases are used to heat or roast the peanuts by convection. In turn the interior of the kernel is heated by conduction. Experience has shown that microwave roasting produces a very uniform product in shorter times. As with conventional roasting aflatoxin content is reduces. However, to reduce the aflatoxin content to an acceptable level often results in over roasting and thus browning and/or nutritional loss.

Peanuts roasted conventionally require a 30 to 40 minute heating cycle and temperatures of 125° to 150° C. (260° F. to 300° F.) depending on the color desired. Usually, the peanuts have been pre-dried and are normally supplied for roasting containing 7% to 8% moisture. The first part of the cycle thus involves drying. As the material approaches 1%-2% moisture the various color and flavor reactions take place. At the same time, various oils, chemical constituents, and particles are either steam distilled, sublimed, or entrained and exit with the exhaust air.

SUMMARY OF THE INVENTION

It has been found in accordance with the present invention that the reduction of aflatoxin in peanuts can be increased significantly above the 10% to 50% reduction achieved by oven roasting or microwave roasting at atmospheric pressure, without adversely affecting the peanut color and/or nutritional value, by microwave roasting contaminated peanuts under a vacuum. More particularly in accordance with the present invention, the aflatoxin content of peanuts heated under vacuum using microwave energy in accordance with the present invention can be reduced from about 87% to 100%, the latter being predicated upon an undetectable level of aflatoxin in the treated peanuts. Preferably, the contaminated peanuts have a moisture content of from 6% to 15%. A desired moisture content can be achieved by drying or, if too dry initially, by prewetting the peanuts such as with water. Ammonia water is especially effective in that it enhances the aflatoxin removal without any detrimental effect on the end product in that residues of ammonia are removed by the vacuum in the treating chamber. Preferably, the peanuts are conveyed through the vacuum chamber between inlet and outlet ends thereof, and rewetting of the peanuts during the process enhances the aflatoxin removal. Depending in part on the length of the vacuum chamber between the inlet and outlet ends, repeated passes of the peanuts through the chamber, either with or without rewetting of the peanuts, can enhance the aflatoxin removal.

Still further in accordance with the invention, the peanuts roast at the same time aflatoxin removal is being achieved, and roasting through the use of microwave energy causes the peanuts to roast from the inside out, thus promoting product quality such as uniformity of roast. Different microwave energy levels, heating times and vacuum pressures can be combined to provide a high quality product with respect to such parameters as color, taste, odor and nutritional value having extremely low, acceptable levels of aflatoxin content. The process according to the present invention is also applicable to the reduction of aflatoxin to acceptable low levels in other seeds and grains such as corn.

The process according to the present invention can be carried out using apparatus such as that disclosed in U.S. Pat. No. 5,020,237 owned by the assignee of the present invention and the disclosure of which is incorporated herein by reference. The apparatus disclosed in the latter patent includes an elongate chamber through which moisture bearing foods, particularly fruits, are moved by a conveyor belt between inlet and outlet ends of the chamber. The chamber is maintained at a vacuum, and the foods are dried in sequential zones by simultaneously subjecting foods to combined microwave and infrared heating as they move through the chamber. In practicing the present invention using such apparatus, the latter would be modified by disconnecting or removing the infrared radiation heating units and by appropriately adjusting the microwave power level and the vacuum pressure, as will become apparent hereinafter. It will be appreciated and readily apparent to those skilled in the art that other equipment can be used to practice the present invention in that it is well known that the amount of microwave energy required to achieve the desired end results is dependent in part on the design of the vacuum chamber and the amount and rate of conveying of the contaminated material therethrough.

It is accordingly an outstanding object of the present invention to provide an improved method for reducing the aflatoxin content of contaminated peanuts and grains.

Another object is the provision of an improved method for reducing the aflatoxin content of peanuts and grains so as to minimize the aflatoxin content while obtaining high product quality including color, taste and nutritional value.

A further object is the provision of an improved method for reducing the aflatoxin content of seed and grains which reduces the process time and cost relative to procedures heretofore available for the same purpose.

Yet another object is the provision of an improved method for reducing the aflatoxin content of seeds and grain by heating the contaminated product in a vacuum chamber using microwave energy.

Still a further object is the provision of an improved method for reducing the aflatoxin content of seeds and grain, and especially peanuts, which is more effective with respect to the quantity of aflatoxin which can be removed without adversely affecting product quality including color, taste and nutritional value.

A further object is the provision of an improved method for reducing the aflatoxin content of peanuts while simultaneously providing for roasting of the peanuts and which method produces peanuts having an aflatoxin content well below acceptable levels and a high product quality including color, taste and nutritional value.

DESCRIPTION OF PREFERRED EMBODIMENTS

According to the invention, the aflatoxin content of contaminated grain and seeds can be effectively reduced to well below acceptable levels by subjecting the contaminated product to heating by microwave energy in a vacuum chamber. The vacuum in the chamber is maintained by the use of a vacuum pump and suitable condenser. As pointed out earlier, microwave radiation is penetrative and in fact the interior of the nut or cereal kernel will heat first. This forces the migration of moisture and oily constituents to the outer surface of the kernel. Furthermore, it assures that the interior of the kernel will achieve the temperature desired for the destruction of aflatoxin. It can be expected that the high temperature in vacuum would enhance any distillation or sublimation of certain chemical constituents from the kernels. Thus, at least some of the aflatoxins will accompany various oils and oil-like fractions to the port leading to the vacuum system. Analysis of traps placed in the vacuum line have shown significant quantities of aflatoxins. The use of vacuum roasting or heating makes possible a closed system wherein condensates can be collected and detoxified by appropriate agents. More particularly in this respect, the vacuum pump continuously withdraws air and vapors of water, oil and entrained substances which are passed over a condenser preceding the vacuum pump. The condensate produced by the condenser is held in a closed vessel and heated by sodium hydroxide or other detoxifying agent before being discharged to atmosphere. Aflatoxin removal is also enhanced, especially where the initial toxin level in ppb is high, by repeated passes of the material through the vacuumized microwave heating chamber, either with or without rewetting of the contaminated material between passes.

There are a number of variables in the process parameters which enable a significant reduction in aflatoxin content of seeds and grains to be achieved by microwave heating of the contaminated product in a vacuum in accordance with the invention. In this respect, it has been found that the reduction of aflatoxin to acceptable levels in contaminated seed and grain having a pretreated moisture content of from 6% to 15% can be achieved with the microwave power adjusted to heat the contaminated product to a temperature from about 110° C. to 200° C. in a chamber maintained under a vacuum of about 25 Torr to 100 Torr, and preferably about 60 Torr, for a time between about 15 minutes to 45 minutes. Preferably, the heating is achieved with a total microwave energy of from about 0.1 to 1 KW per pound of contaminated product processed. It will be appreciated, of course, that the preferred parameters for a particular process run, including ranges for such parameters, will be determined at least in part by the contaminated product and the characteristics other than level of contamination desired with respect thereto following the process, such as color, flavor and nutritional value. Other factors bearing upon the determination of particular process parameters are the initial level of contamination of the material in ppb, and the initial moisture content of the product. With regard to the latter, the process according to the invention does not require that the product have an initial moisture content of from 6% to 15%. The latter, however, is preferred with respect to optimizing aflatoxin removal and a quality end product, efficiently and with the time, temperature and vacuum factors in the preferred ranges set forth above.

In practicing the invention, it is preferred to continuously introduce contaminated material into one end of an elongate horizontal tank-like structure having a conveyor belt or rotating screw for moving the material from one end of the tank to the other and through one or more microwave heating zones within the tank between the ends thereof. The interior of the tank provides a processing chamber in which the heating zones are located, and a vacuum is maintained in the chamber by withdrawing air or other gas therethrough by means of a vacuum pump or the like. Airlocks can be provided at the entrance and exit ends of the chamber or tank to enable the continuous introduction of contaminated material and a continuous discharge of decontaminated material from the tank without interfering with the vacuum maintained in the processing chamber.

In connection with continuous processing in the foregoing manner, it may be necessary to have more than one heating zone to assure maintaining the contaminated material at the desired temperature for aflatoxin removal for the time required to move the material through the process chamber and which time, of course, provides for a predetermined reduction in the level of contamination of the material. Furthermore, especially in connection with the processing of peanuts, it may be necessary to provide for the microwave power level in successive heating zones to be reduced relative to the preceding zone in order to maintain the product at a uniform temperature as it moves through the process chamber. In this respect, as the moisture content of the product decreases during movement through the process chamber, microwave energy at the same power level will tend to increase the temperature of the material, and care must be taken that the end result of such temperature increase does not over roast the peanuts resulting in an end product which, while having an acceptable aflatoxin content, is decreased in commercial value because of darkening and/or loss of flavor and nutritional value.

The following examples are illustrative of the process of the present invention. In each of the examples, temperatures were determined by suitably calibrated, infrared, pyrometers and microwave energy levels were controlled in response to sensed temperatures. Further, in each example toxic laden vapors were continuously withdrawn from the vacuum chamber, condensed and detoxified before being discharged to atmosphere. Aflatoxin content was determined before and after processing by grinding and mixing 40 pound samples, extracting and chromotographing the extract for detection by ultraviolet fluorescence. Less than 1 ppb can be detected by this method.

EXAMPLE I

Forty pounds of peanuts containing 77 ppb aflatoxins and 7% moisture were introduced into a microwave chamber and conveyed therethrough on a belt at a rate of 40 pounds per hour. The chamber was maintained at a vacuum of 60 Torr. In a first heating zone, microwave energy averaging about 9 KW was utilized for 7 minutes and elevated the temperature of the peanuts to 110° C. In a second zone, and for the next 7 minutes, microwave energy averaging about 8 KW was focused on the moving product elevating the temperature thereof to 126° C. For the next 14 minutes, and in a third heating zone, microwave energy averaging between 3 to 5 KW was utilized to elevate the temperature of the product to 137° C. and to maintain this temperature. Thus, the peanuts were subjected to a total average of 20–23 KW of microwave energy for a total of 28 minutes. The peanuts were then allowed to cool for an additional 14 minutes during passage through a fourth, unheated, zone in the vacuum chamber. The processed peanuts appeared slightly roasted and had an aflatoxin content of 0 to 3 ppb, amounting to a reduction of from about 96% to 100%.

EXAMPLE II

Forty pounds of granulated peanuts (¼" pieces) containing 60 ppb aflatoxin and 7% moisture were processed as in EXAMPLE I, but at a rate of movement through the vacuum chamber of 60 pounds per hour which resulted from a thicker and thus shorter layer of product on the belt relative to the peanuts of EXAMPLE I. The belt speed was the same as in EXAMPLE I, whereby the granulated peanuts were heated for the same times and at the same microwave energy levels as in EXAMPLE I. Aflatoxin contents on samples after the treatment ranged from 3 to 8 ppb, amounting to a reduction of from about 87% to 95%.

EXAMPLE III

Forty pounds of shelled almond nuts containing 50 ppb aflatoxin and 7% moisture were processed as in EXAMPLE I. The aflatoxin content after processing was 0 ppb, amounting to a reduction of 100%.

EXAMPLE IV

Forty pounds of peanuts containing 77 ppb aflatoxin and 7% moisture were introduced into a microwave chamber maintained at a vacuum of 60 Torr and were conveyed therethrough at a rate of 40 pounds per hour. The peanuts were subjected to a very light roasting in passing through three heating zones as in EXAMPLE I for a total of 28 minutes during which the temperature of the peanuts was elevated to and maintained at a temperature no higher than 118° C. by utilizing microwave energy totaling an average of 20 KW. As in EXAMPLE I, the peanuts were cooled for 14 minutes in the fourth unheated zone. The aflatoxin content following processing ranged from 0 to 8 ppb, amounting to a reduction of from about 90% to 100%.

EXAMPLE V

Forty pounds of peanuts containing 110 ppb aflatoxin and having a moisture content of 7% were roasted to a medium brown while being conveyed through a vacuum chamber maintained at a vacuum of 60 Torr. The peanuts were conveyed through three heating zones in the chamber at a rate of 40 pounds per hour, and the temperature of the peanuts was elevated to 137° C. over a first period of 14 minutes and maintained at 137° C. for a second period of 14 minutes by utilizing microwave energy totalling an average of 20 KW. As in EXAMPLE I, the peanuts were cooled in the fourth unheated zone for 14 minutes. The aflatoxin content of the processed peanuts was 7.5 ppb, amounting to a reduction of about 93%.

EXAMPLE VI

Forty pounds of peanuts containing 3.5 ppb aflatoxin was exposed to a saturated atmosphere of water in a closed container until the moisture content thereof reached 17%. The peanuts were then introduced into a vacuum chamber maintained at a vacuum of 60 Torr and were conveyed through the chamber at a rate of 40 pounds per hour for the same time and at the same temperature levels as in EXAMPLE IV. The peanuts were very lightly roasted as a result of the extra moisture, and the aflatoxin content after processing was 0 ppb, amounting to a reduction of 100%.

EXAMPLE VII

Forty pounds of dried corn having a moisture content of 11.5% and containing 299 ppb aflatoxin were introduced into a vacuum chamber maintained at a vacuum of 60 Torr and conveyed through the chamber at a rate of 40 pounds per hour. Microwave energy averaging about 6 KW and 4 KW was utilized in first and second heating zones, respectively, to elevate the temperature of the corn to 124° C. during a first period of 15 minutes, and microwave energy averaging about 1 KW was utilized to maintain the temperature of the corn between 124° C. and 130° C. for a second period of 13 minutes, thus providing a total average of 11 KW for a total of 28 minutes. The aflatoxin content after processing was 49 ppb, amounting to a reduction of about 84%.

Although the present invention has been described with respect to various specific embodiments, various modifications will be apparent from the present disclosure and are intended to be within the scope of the following claims.

What is claimed is:

1. A method of reducing the aflatoxin content of contaminated seed having an initial moisture content of from 6% to 17% comprising, placing said seed in a chamber, heating said seed in said chamber by microwave radiation to a temperature from about 110° C. to 200° C. for a period of from about 15 minutes to 45 minutes, and maintaining said chamber under a vacuum of from about 25 Torr to 100 Torr during said heating.

2. The method according to claim 1, and conveying said seed through said chamber during said heating.

3. The method according to claim 1, wherein said heating of said seed in said chamber is with microwave energy between about 0.1 and 1 KW per pound of seed.

4. The method according to claim 1, and varying the level of microwave energy to progressively increase the temperature of said seed in said chamber.

5. The method according to claim 1, and further including sensing the temperature of said seed in said chamber and controlling the level of microwave energy in response to said sensed temperature.

6. The method according to claim 1, and conveying said seed through said chamber at a rate of from 40 to 60 pounds per hour during said heating.

7. The method according to claim 1, and continuously withdrawing vapors from said chamber, condensing said vapors, heating the condensed vapors with a detoxifying agent, and discharging the detoxified matter to atmosphere.

8. The method according to claim 7, and further including sensing the temperature of said seed in said chamber and controlling the level of microwave energy in response to said sensed temperature.

9. The method according to claim 7, further including pretreating said seed with water and rewetting said seed during heating thereof.

10. The method according to claim 9, wherein said water includes ammonia water.

11. The method according to claim 1, wherein said heating is in first, second and third stages to progressively heat said seed to progressively increasing first, second and third temperatures.

12. The method according to claim 11, and cooling said seed from said third temperature in said chamber and under said vacuum.

13. The method according to claim 11, wherein said vacuum is about 60 Torr.

14. The method according to claim 11, wherein said heating in said first, second and third stages respectively utilizes microwave energy at progressively decreasing first, second and third KW levels for respective first, second and third periods of time.

15. The method according to claim 14, and cooling said seed from said third temperature in said chamber and under said vacuum for a fourth period of time.

16. The method according to claim 14, wherein said first, second and third KW levels respectively are 9 KW, 8 KW and 3 to 5 KW, and said first, second and third periods of time respectively are 7 minutes, 7 minutes and 14 minutes.

17. The method according to claim 16, wherein said first, second and third temperatures respectively are 110° C., 126° C. and 137° C.

18. The method according to claim 17, and cooling said seed from said third temperature in said chamber and under said vacuum for about 14 minutes.

19. The method according to claim 18, wherein said vacuum is about 60 Torr.

20. The method according to claim 17, wherein said seed is peanuts having an initial moisture content of 7% and said vacuum is about 60 Torr, and conveying said peanuts through said chamber at a rate of 40 pounds per hour.

21. The method according to claim 17, wherein said seed is granulated peanuts having an initial moisture content of 7% and said vacuum is about 60 Torr, and conveying said granulated peanuts through said chamber at a rate of 60 pounds per hour.

22. The method according to claim 17, wherein said seed is almond nuts having an initial moisture content of 7% and said vacuum is about 60 Torr, and conveying said almond nuts through said chamber at a rate of 40 pounds per hour.

23. The method according to claim 1, wherein said seed is peanuts having an initial moisture content of 7% and said heating of said seed is for a period of 28 minutes at a temperature not exceeding 118° C.

24. The method according to claim 23, wherein said heating utilizes microwave energy at a total average of 20 KW.

25. The method according to claim 24, wherein said vacuum is about 60 Torr, and conveying said seed through said chamber at a rate of 40 pounds per hour.

26. The method according to claim 1, wherein said seed is peanuts having an initial moisture content of 7%, said heating of said seed including heating said peanuts to a temperature of 137° C. during a first period of 14 minutes and maintaining said peanuts at said temperature for a second period of 14 minutes.

27. The method according to claim 26, wherein said heating during said first and second periods utilizes microwave energy totalling an average of 20 KW.

28. The method according to claim 27, wherein said vacuum is about 60 Torr, and conveying said peanuts through said chamber a rate of 40 pounds per hour.

29. The method according to claim 1, wherein said seed is peanuts having an initial moisture content of 7%, and increasing the initial moisture content of said peanuts to 17% before heating, said heating of said seed being for a period of 28 minutes and at a temperature not exceeding 118° C.

30. The method according to claim 29, wherein said heating utilizes microwave energy at a total average of 20 KW.

31. The method according to claim 30, wherein said vacuum is about 60 Torr, and conveying said peanuts through said chamber at a rate of 40 pounds per hour.

32. The method according to claim 1, wherein said seed is dried corn having an initial moisture content of 11%, said heating of said seed including heating said corn to a temperature of 124° C. during a first period of 15 minutes and maintaining said corn at a temperature between 124° C. and 130° C. for a second period of 13 minutes.

33. The method according to claim 32, wherein said heating during said first period utilizes microwave energy at an average level of 10 KW and said maintaining of said temperature utilizes microwave energy at an average level of 1 KW.

34. The method according to claim 33, wherein said heating during said first period is in first and second stages respectively utilizing microwave energy averaging about 6 KW and 4 KW.

35. The method according to claim 34, wherein said vacuum is about 60 Torr, and conveying said corn through said chamber at a rate of 40 pounds per hour.

36. A method of reducing the aflatoxin content of contaminated seed comprising, placing said seed in a chamber, heating said seed to a temperature from about 110° C. to 200° C. for a period of about 28 minutes utilizing microwave energy averaging a total of from about 20 to 23 KW, and maintaining said chamber at a vacuum during said heating.

37. The method according to claim 36, wherein said seed is peanuts.

38. The method according to claim 36, wherein said seed is almond nuts.

39. The method according to claim 36, wherein said seed is corn.

40. The method according to claim 36, wherein said vacuum is maintained at about 60 Torr.

41. The method according to claim 36, and continuously conveying said seed through said chamber at a rate between about 40 to 60 pounds per hour.

* * * * *